US007402065B1

(12) United States Patent
Polnyi

(10) Patent No.: US 7,402,065 B1
(45) Date of Patent: Jul. 22, 2008

(54) SOCKET CONNECTOR FOR CARRYING INTEGRATED CIRCUIT PACKAGE

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/906,861

(22) Filed: Oct. 3, 2007

(51) Int. Cl.
*H01R 13/62* (2006.01)

(52) U.S. Cl. ..... 439/331; 411/531; 411/532; 411/536

(58) Field of Classification Search ..... 439/331; 411/531, 532, 536
See application file for complete search history.

(56) References Cited

U.S. PATENT DOCUMENTS 3,552,698 A * 1/1971 Kinney ..... 248/158
4,067,184 A * 1/1978 Johnson, Jr. ..... 57/135
4,929,185 A * 5/1990 Wong et al. ..... 439/74
7,227,761 B2 * 6/2007 Estes et al. ..... 361/810
2006/0141840 A1 * 6/2006 Ma ..... 439/331

* cited by examiner

*Primary Examiner*—Tho D Ta
(74) *Attorney, Agent, or Firm*—Wei Te Chung

(57) ABSTRACT

A socket connector includes a metallic stiffener, an insulative housing, a load plate, a load lever and a plurality of washers. The stiffener defines a central opening in a middle portion thereof, the opening being surrounded by two pairs of inner surfaces. The housing defines a recessed conductive zone surrounded by sidewalls. The housing partially received in the opening of stiffener, and sidewalls interferentially engage with the inner surfaces in a direction parallel to the opening. The stiffener defines a plurality of through holes around the opening. Each of the through holes has two washers assembled therein from both sides of the stiffener; and every two washers assembled in a same through hole define a passageway in the middle thereof.

15 Claims, 8 Drawing Sheets

SOCKET CONNECTOR FOR CARRYING INTEGRATED CIRCUIT PACKAGE

FIELD OF THE INVENTION

This application is related to currently pending patent application Ser. No. 11/288,817, field on Nov. 28, 2005, which has been allowed. The present invention relates to a socket connector, on which an LGA (land grid array) integrated circuit (IC) package is mounted.

DESCRIPTION OF PRIOR ART

Modern computer systems increase in performance and complexity at a very rapid pace, driven by intense competition and market demands. In order to meet ever-increasing performance requirements, the area and volumetric interconnect densities of electronic board assemblies must increase accordingly. In combination with other competitive forces, this demand has driven the need for improved high-density socket technologies in computer applications, and the connector industry has responded with a variety of new alternatives to meet these needs. One of the most attractive of the new connector types is the land grid array (LGA) socket connector, which permits direct electrical connection between an LGA integrated circuit and a printed circuit board. LGA socket connectors are an evolving technology in which an interconnection between mating surfaces of an IC or other area array device and a printed circuit board is provided through a conductive terminal received in the socket connector. Connection is achieved by mechanically compressing the IC onto the socket connector.

Chinese Pat No. 2004 2 0054130.5 issued on Feb. 8, 2006 discloses another typical type of socket connector for carrying an IC package and electrically connecting the IC package to a circuit board, e.g. a PCB. The socket connector comprises a metallic stiffener, an insulative housing, a load plate, a load lever and a plurality of plastic supporting posts. The stiffener defines a central opening in a middle portion thereof, the opening being surrounded by two pairs of inner surfaces. The housing defines a recessed conductive zone surrounded by sidewall. The stiffener defines a plurality of through holes on four corners thereof. The plastic supporting posts are partially received in the through holes and arranged between the stiffener and the circuit board. A plurality of screws passes through the through holes for mounting the stiffener onto the circuit. The plurality of plastic supporting posts is used for separating the stiffener from the circuit board; therefore the stiffener is easily removed. Apparently, the plastic supporting posts don't carry function of attachment stiffener to the circuit board and mechanical connection between the stiffener and the circuit board is unsteady.

Accordingly, there is a room for improving the existing socket connector such that the operation of removing the pickup cap can be easily done.

SUMMARY OF THE INVENTION

It is an object of the present invention to provide a socket connector, which enables a steady mechanical connection between the stiffener and the circuit board.

In order to achieve the object set forth, an improved socket connector is provided to resolve the disadvantages described above. The socket connector includes a metallic stiffener, an insulative housing, a load plate, a load lever and a plurality of washers. The stiffener defines a central opening in a middle portion thereof, the opening being surrounded by two pairs of inner surfaces. The housing defines a recessed conductive zone surrounded by sidewalls. The housing partially received in the opening of stiffener, and sidewalls interferentially engage with the inner surfaces in a direction parallel to the opening. The stiffener defines a plurality of through holes around the opening. Each of the through holes has two washers assembled therein from both sides of the stiffener; and every two washers assembled in a same through hole define a passageway in the middle thereof, one washer located below the stiffener while another located above the stiffener. A plurality of posts interferentially engages with the passageways and holes on a PCB, so steady mechanical connection between the stiffener and circuit board is possibly provided.

For the housing partially received in the opening of stiffener or only surrounded by the stiffener, the stiffener can be removed from the housing easily without damaging the connector. Further more, while the connector is mounted on a PCB, parts of the washer below the stiffener can prevent the connection between the stiffener and the PCB, which enables preventing short circuit of the PCB.

Other advantages and novel features of the present invention will become more apparent from the following detailed description when taken in conjunction with the accompanying drawings, in which:

DESCRIPTION OF PREFERRED EMBODIMENT OF THE INVENTION

Hereinafter, a preferred embodiment of the invention will be described in detail with reference to the attached drawings.

Figure 1:
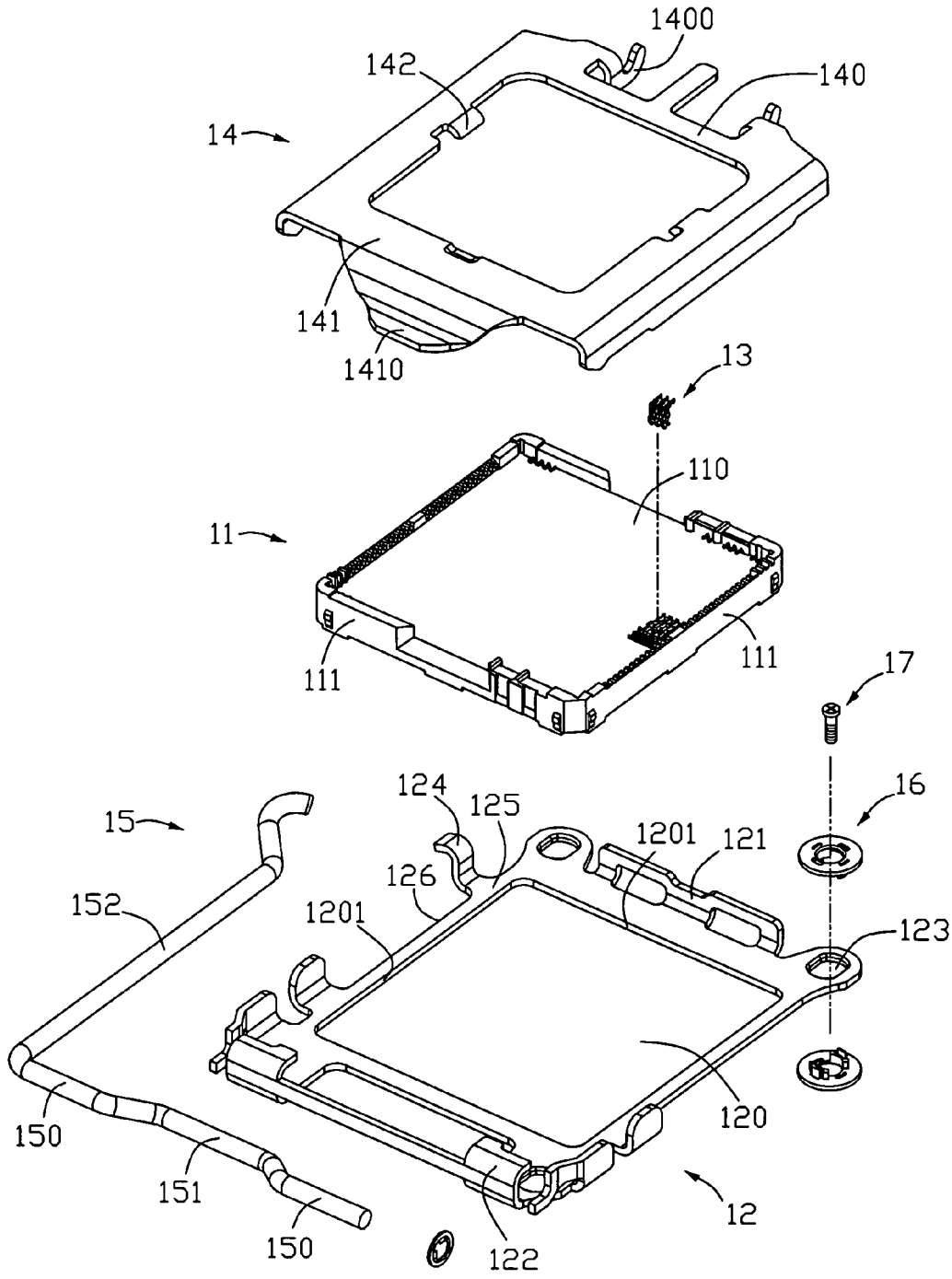
FIG. 1 is an exploded isometric view of a socket connector in accordance with a preferred embodiment of the present invention.
Figure 2:
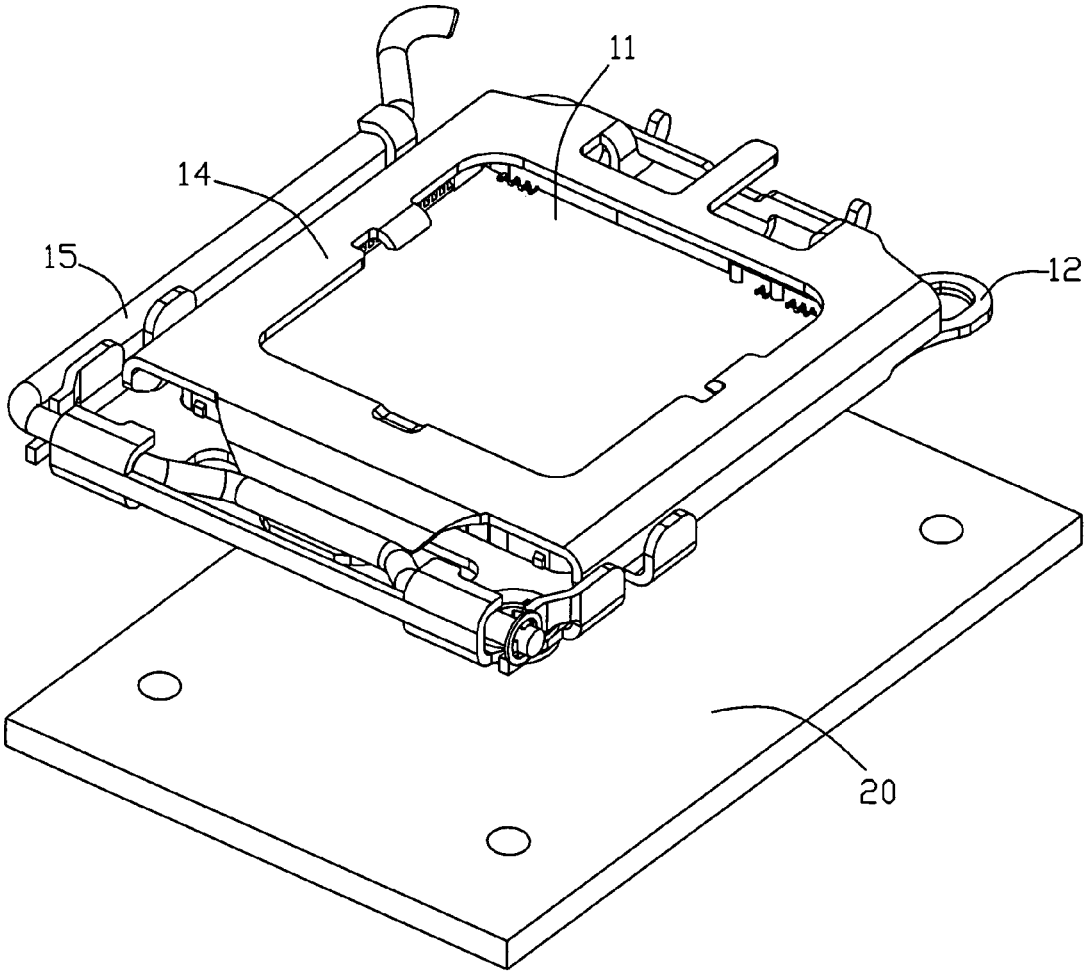
FIG. 2 is an assembled view of the socket connector.

Referring to FIGS. 1-2, an socket connector 10 for carrying an IC package (not shown) to be electrically connected to a PCB 20. The socket connector comprises an insulative housing 11, a metallic stiffener 12 engageable with the housing 11, a plurality of conducive terminals 13 received in the housing 11, a load plate 14 pivotally assembled to one end of the stiffener 12, a load lever 15 pivotally assembled to the stiffener 12, and a plurality of washers 16 attached to the stiffener.

The insulative housing 11 defines a recessed conductive zone 110 surrounded by two pairs of sidewalls 111. The terminals 13 are fixed in the conductive zone 110.

The metallic stiffener 12 is formed by stamping form a metallic sheet. The stiffener 12 defines an opening 120 in a middle portion thereof. The opening is generally rectangular and is surrounded by two pairs of inner surfaces 1201. The stiffener 12 defines a first end 121 and a second end 122 separated by the opening 120. A plurality of engaging through holes 123 is arranged surrounding the opening in the stiffener. In this embodiment, the engaging through holes 123 is arranged in four corners of the stiffener 12. The stiffener 12 defines an upper surface 125 and a lower surface 126 opposite to the upper surface 125. The through holes 123 extend through both side upper surface 125 and the lower surface 126. The stiffener 12 further comprises a block 124 located close to the first end 121. In this embodiment, the sidewalls of the housing 10 interferentially engage with the inner surface 1201 of the opening 120. Furthermore, in an alternative embodiment, the housing 10 is only surrounded by the opening 120 but without interference therebetween.

The load plate 14 is generally rectangular and includes a rear end 140, a front end 141 and two opposed pressing beams 142 connecting therebetween. The load plate 14 defines two spaced pivotal portions 1400 extending from the rear end 140 and an acting portion 1410 extending from the front end 141.

The load lever 15 is generally L-shaped, and comprises a pivotal section 150, a pressing section 151 protruding from the pivotal section 150, and an operating section 152 extending form a distal end of the pivotal section 150.

Referring to FIG. 2, in assembly, the housing 11 assembles with the stiffener 12 by virtue of interference force between the sidewalls 111 of the housing and the inner surfaces 1201 of the stiffener 12. The load plate 14 and the load lever are received in opposite ends of the stiffener 12, respectively.

Referring to FIG. 2, after the socket connector 10 is assembled, the pivotal portion 1400 of the load plate 14 is pivotally engaged with the first end 121 of the stiffener 12, and the pivotal section 150 is pivotally engaged with the second end 122 of the stiffener 12. When used, the socket connector 10 should be mounted on a PCB 20. After an IC package (not shown) is mounted on the housing 11, the pressing beams of the load plate 14 press on peripheral portions of the IC package, and the acting portion 1410 is suppressed by the pressing section 151 of the load lever 15. In order to stably fix the IC package in the connector, the operating section 152 is restricted by the block 124 of the stiffener 12.

Figure 3:
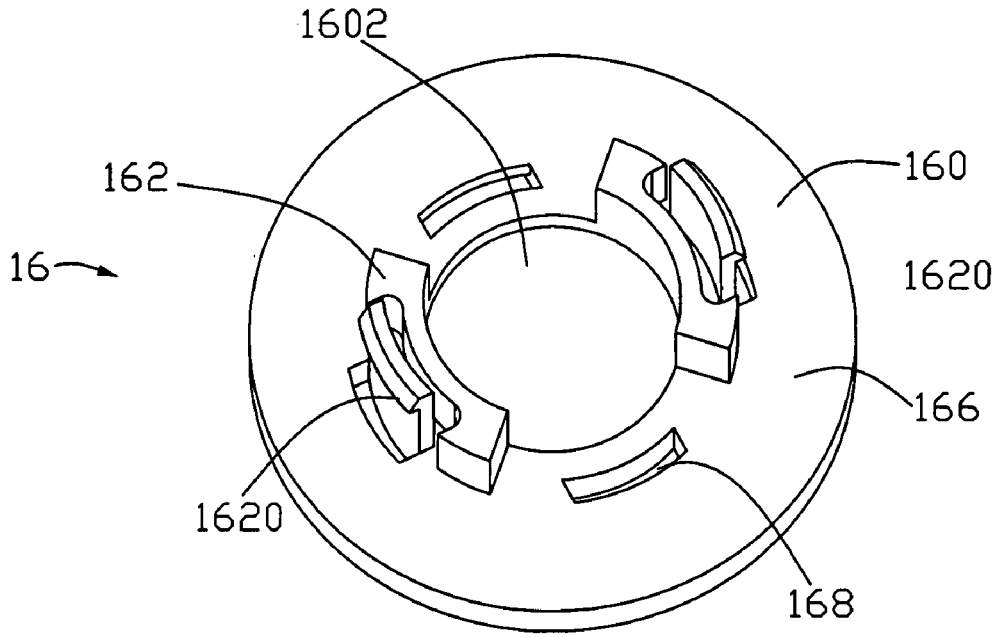
FIG. 3 is an isometric view of a washer of the socket connector.
Figure 4:
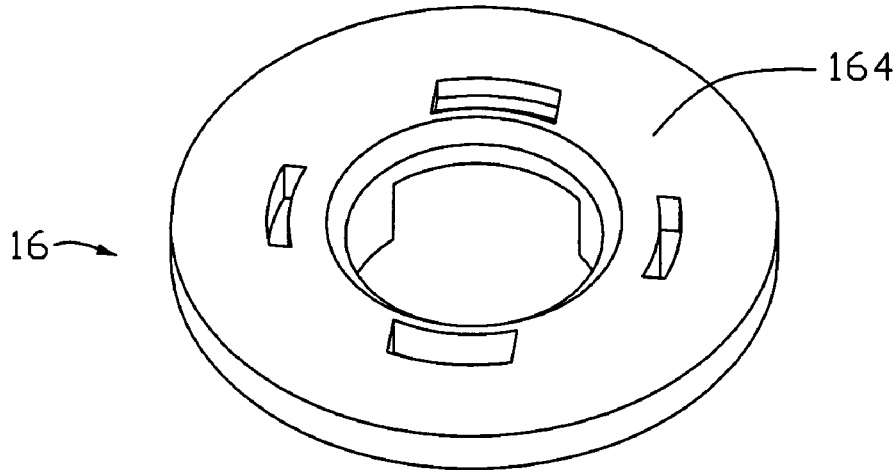
FIG. 4 is similar to FIG. 3, but from another perspective view.
Figure 5:
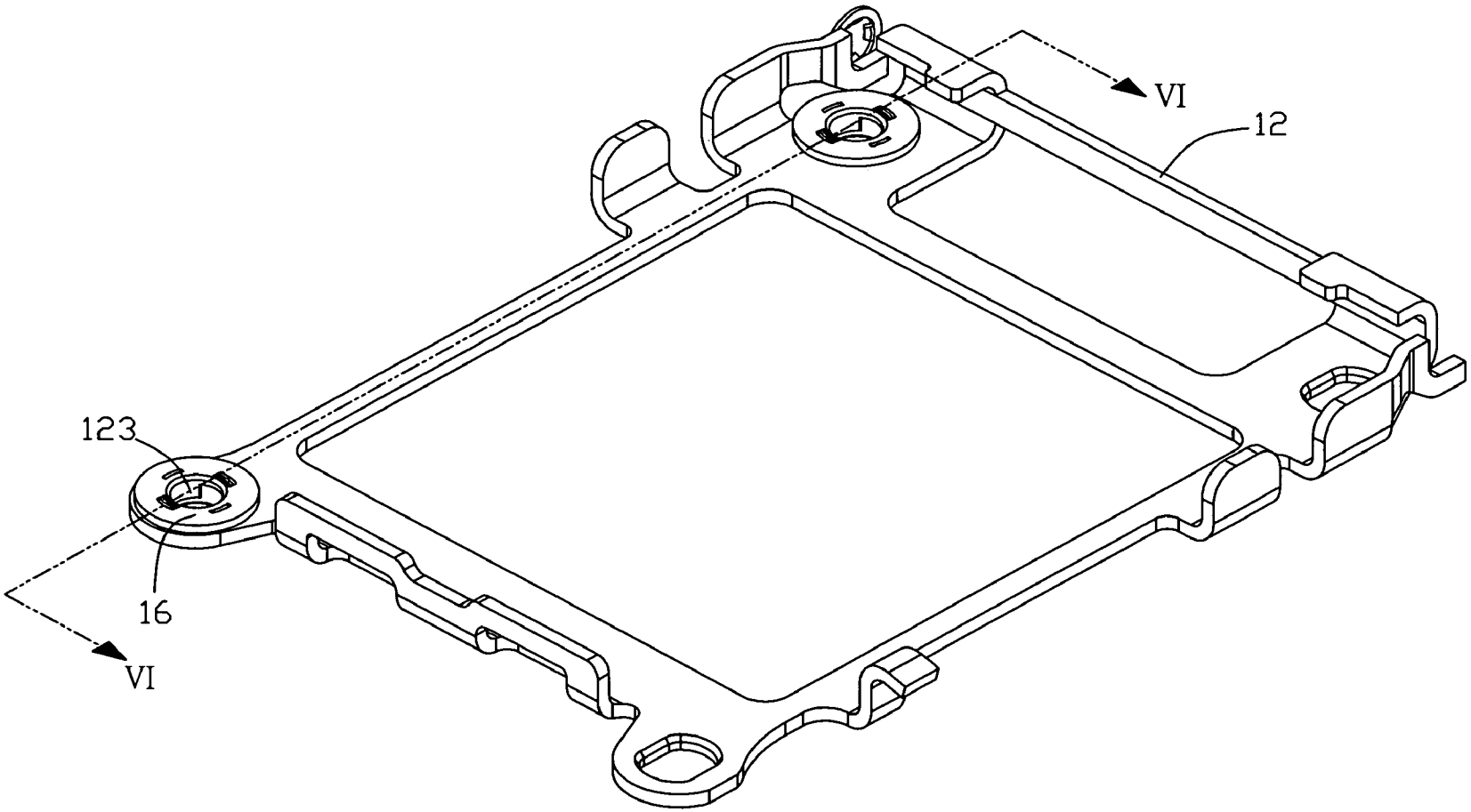
FIG. 5 is an assembled view of the stiffener and the washers, showing each of the through holes assembled with two washers.
Figure 6:
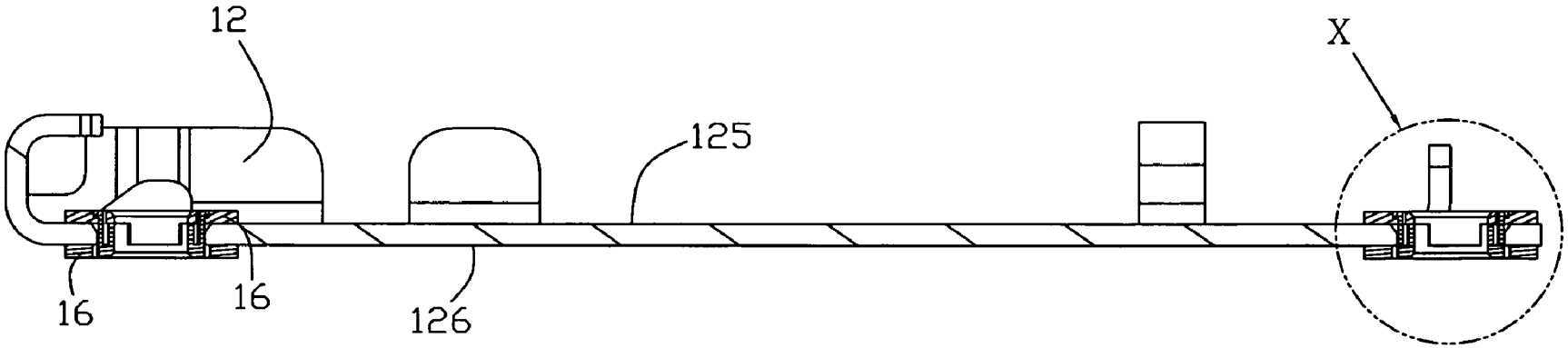
FIG. 6 is a cross-sectional view along line VI-VI in FIG. 5.
Figure 7:
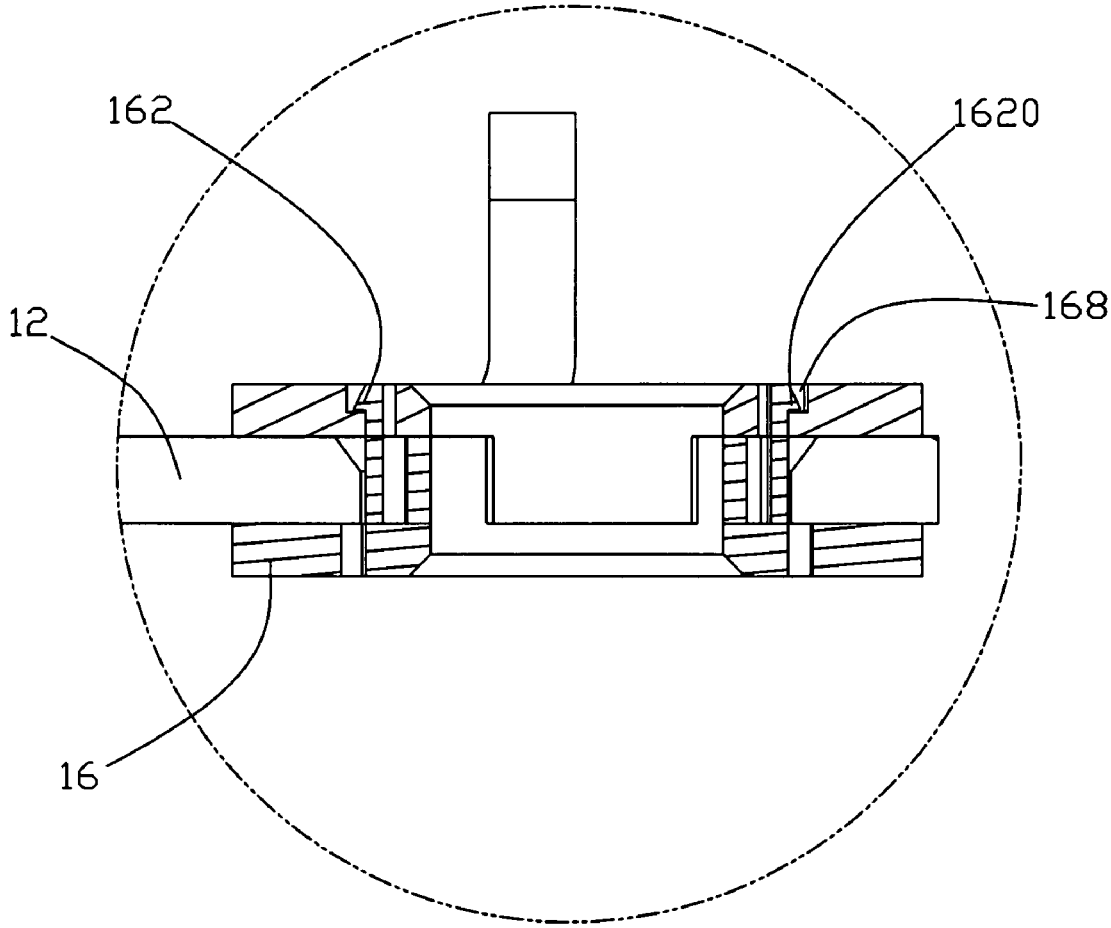
FIG. 7 is an enlarged view of the circle portion X in FIG. 6.
Figure 8:
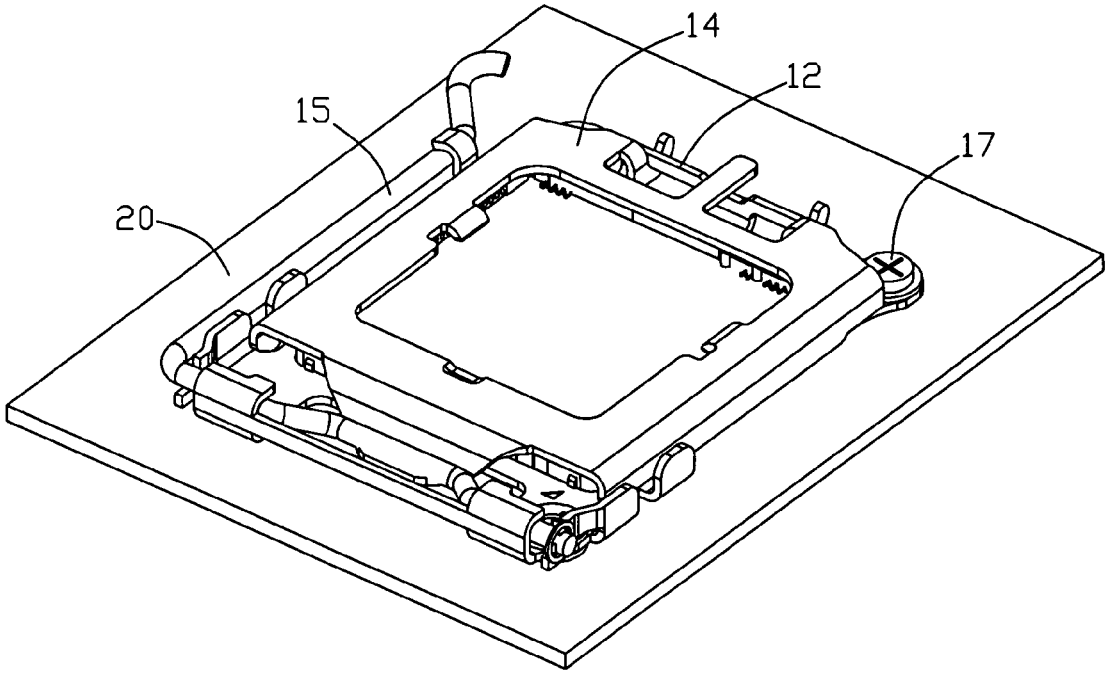
FIG. 8 is an assembled view of the socket connector, the socket connector being mounted on a printed circuit board.
Figure 9:
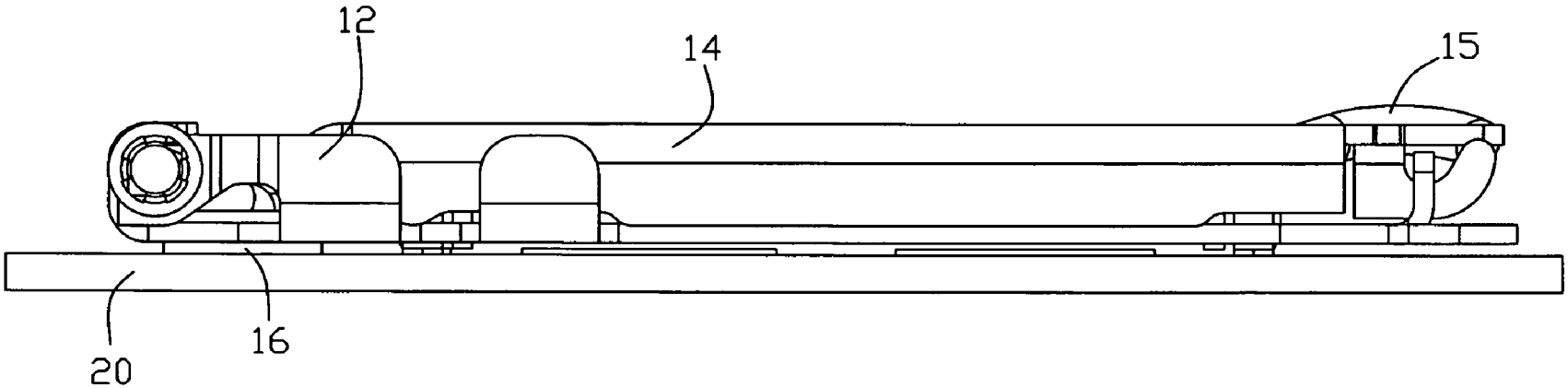
FIG. 9 is a side view of the socket connector shown in FIG. 8.

Referring to FIGS. 3-4, each of the washers 16 includes a body portion 160 and a pair of snapped portions 162 extending from the body portion 160. The body portion 160 defines an upper surface 164 and a lower surface 166 opposite to the upper surface 164, and a passage 168 extends through both said upper surface 164 and lower surface 166. The body portion 160 is generally configuration of a plate like structure and of a circle shape. The passage 1602 defined between said upper surface 164 and lower surface 166 is also in a circle shape. The pair of snapped portions 162 extends from the upper surface 164 and is disposed around said passage 1602 with a manner of symmetry. A pair of slots 168 extends through both said upper surface 164 and lower surface 166 and is disposed around said passage 1602 symmetrically, wherein each of the two slots 168 is disposed between two snapped portion 168 but is not adjacent to each other. In another word, said snapped portions 162 and slots 168 are evenly distribution around the passage 1602. Furthermore, the snapped portion 162 defines a clasp 1620 on a free end thereof, and the slot 168 defines a protrusion (not labeled) engageable with said clasp.

Referring to FIGS. 5-9, in assembly, each of the through holes 123 contains two washers 16 assembled therein. One of the two washers 16, which are assembled in a same through hole 123 of the stiffener 12, is located below the upper surface 126 and another one is located on the upper surface 125. Said two washers 16 are snapped together from both sides of the stiffener 12. In detail, the two washers are rotated by 90 degree to each other, wherein said snapped portion 162 of one washer 16 is interferentially inserted into slots 168 of another washer 16. After the washers 16 assembled to the through holes 123 of the stiffener 12, a passageway is defined in a middle portion of the two washers 16.

Additionally, as shown in FIG. 1, the connector 10 further comprises a plurality of posts 17 for connecting the stiffener 12 to the PCB. In assembly, the posts 16 pass through the passageway in the middle portion of the washers 16 and interferentially insert into holes (not shown) of the PCB, so as to connect the stiffener 12 to the PCB. Also, the passageway in the middle portion of the two washers 16 interferentially engages with the post 17. Each of the through holes 123 of the stiffener 12 contains two washer 16 snapped together, so the washer 16 carries full function on both sides of the stiffener 12. Parts of the washer below the stiffener can prevent the connecting between the stiffener 12 and the PCB, which enables preventing short circuit of the PCB. For the housing 10 partially received in the opening of stiffener 12 or only surrounded by the stiffener 12, the stiffener 12 can be removed from the housing 10 easily without damaging the connector. By way mentioned above, steady mechanical connection between the stiffener and the circuit board is possibly provided Furthermore, although the present invention has been described with reference to particular embodiments, it is not to be construed as being limited thereto. Various alterations and modifications can be made to the embodiments without in any way departing from the scope or spirit of the present invention as defined in the appended claims.

I claim:

1. A socket connector for carrying an integrated circuit package, comprising:

an insulative housing defining a recessed zone surrounded by two pairs of sidewalls;

a plurality of conductive terminals received in the recessed zone;

a metallic stiffener defining an upper side and a bottom side opposite to each other, and an opening surrounded by two pairs of inner surfaces, the opening surrounding the housing;

a load plate and a load lever a pivotally assembled to the stiffener;

the stiffener defining a plurality of through holes through both said upper and bottom sides and around the opening; wherein the connector further comprises a plurality of washers, each of the through holes having two washers assembled therein from both sides of the stiffener; wherein every two washers assembled in a common one of said through holes, define a passageway in the middle thereof; wherein each of the washers comprises a body portion having an upper surface and a lower surface opposite to upper surface, a passage defined between the upper surface and the lower surface; wherein the body portion of one of said two washers defines a snapped portion and the body of the other of said washers defines a slot into which said snapped portion is engaged; wherein the body portion of at least one of said two washers extends through said common through hole so as to have said snapped portion engaged within the slot for pre-assembling said two washers with each other and further to the stiffener under a condition that the stiffener is sandwiched between said two washers.

2. The socket connector as claimed in claim 1, wherein the sidewalls interferentially engage with the inner surfaces of the opening in the stiffener.

3. The socket connector as claimed in claim 1, wherein the load plate is pivotally assembled to one end of the stiffener, and the load lever is pivotally assembled to an opposite end of the stiffener.

4. The socket connector as claimed in claim 1, wherein the two washers assembled within the common through hole of the stiffener are configuration of a same structure.

5. The socket connector as claimed in claim 1, wherein the passage is of a circle shape, said snapped portions and slots are evenly distribution around the passage.

6. The socket connector as claimed in claim 1, the snapped portion defining a clasp on a free end for engaging with a protrusion in the slot.

7. The socket connector as claimed in claim 6, wherein the body portion is also in a circle shape.

8. A socket connector, for electrically connecting an integrated circuit package to a circuit board, comprising:

an insulative housing having a plurality of contacts receiving therein;

a stiffener surrounding the housing;

a load plate and a load lever pivotally assembled to the stiffener;

wherein the stiffener defines a plurality of through holes, in assembly, a plurality of posts inserted into the through holes and holes of the circuit board for connecting the stiffener to the circuit board;

wherein each of the through holes has two washers assembled therein and engageable with a post, so steady mechanical connection between the stiffener and the circuit board is possibly provided; wherein the two washers assembled therein and two washers are snapped together from both sides of the stiffener; wherein each of the washers defines a body portion having an upper surface and a lower surface opposite to upper surface, a passage defined between the upper surface and the lower surface; wherein the two washers are pre-assembled to each other and further to the stiffener before the post is engaged therewith under a condition that the stiffener is sandwiched between said two washers, and the post extends through the passages of both said washers during mounting the stiffener to the circuit board.

9. The socket connector as claimed in claim 8, wherein the stiffener is not directly imposed upon a downward force by the post but through the one of said two washers which is located upon the stiffener, and the other one of said two washers which is located under the stiffener is essentially tightly sandwiched between the circuit board and the stiffener.

10. The socket connector as claimed in claim 8, wherein the body portion defines a plurality of snapped portions extending from the lower surface and a plurality of slots extending through both said upper and lower surface, in assembly, said snapped portions on one of the two washers interfering inserted into slots one another washer by through the through hole containing said two washers.

11. The socket connector as claimed in claim 10, the snapped portion defining a clasp on a free end for engaging with a protrusion in the slot.

12. A socket connector assembly comprising:

an insulative housing;

a metallic stiffener surrounding the housing under a condition that no permanent securement between the stiffener and the housing;

a plurality of first through holes defined in the stiffener; and a plurality of washer structures attached to the stiffener around the corresponding first through holes, respectively, each of said washer structures including upper and lower washer halves fastened to each other; wherein the upper washer half is located upon the stiffener while the lower washer half is located under the stiffener, under a condition that the stiffener is essentially tightly sandwiched between the upper washer half and the lower washer half so as to no relative vertical movement between the washer structure and the stiffener; wherein in each of said washer structures, at least one of said upper washer half and said lower washer half extends through the corresponding first through hole to the other of said upper washer half and said lower washer half for pre-assembling said upper washer and said lower washer half together and further having said washer structure fastened to the stiffener before said stiffener is mounted to a printed circuit board on which the housing is seated.

13. The socket connector assembly as claimed in claim 12, further including a plurality of posts extending through the corresponding washer structures, respectively, under a condition that the upper washer half instead of the stiffener endures a downward pressure from the corresponding post.

14. The socket connector assembly as claimed in claim 13, said printed circuit board defining therein a plurality of second through holes into which the corresponding posts extend, respectively.

15. The socket connector assembly as claimed in claim 14, wherein said lower washer half is tightly sandwiched between the printed circuit board and the stiffener.

* * * * *